United States Patent [19]

Koutonen et al.

[11] 4,339,904

[45] Jul. 20, 1982

[54] ROLL PACKAGING ARRANGEMENT

[75] Inventors: Pauli Koutonen; Lars-Erik Alanco, both of Järvenpää, Finland

[73] Assignee: Oy Wartsila Ab, Helsinki, Finland

[21] Appl. No.: 88,956

[22] Filed: Oct. 29, 1979

[30] Foreign Application Priority Data

Nov. 3, 1978 [FI] Finland ..... 783352

[51] Int. Cl.[3] ..... B65B 61/22

[52] U.S. Cl. ..... 53/137; 53/211

[58] Field of Search ..... 53/137, 211, 292, 307, 53/380, 571; 414/121, 122, 735, 737

[56] References Cited

U.S. PATENT DOCUMENTS

| | | | |
|---|---|---|---|
| 2,674,074 | 4/1954 | Lancaster et al. | 53/137 |
| 2,890,043 | 6/1959 | Bruns | 414/735 |
| 3,227,290 | 1/1966 | Lemelson | 419/735 |
| 3,411,269 | 11/1968 | Karr | 53/380 |
| 3,892,400 | 7/1975 | Harrison | 271/9 |
| 4,108,933 | 8/1978 | Goransson | 414/121 |

FOREIGN PATENT DOCUMENTS

| | | | |
|---|---|---|---|
| 1275440 | 8/1968 | Fed. Rep. of Germany | 53/137 |
| 2230580 | 12/1974 | Fed. Rep. of Germany | 53/307 |

*Primary Examiner*—John Sipos

*Attorney, Agent, or Firm*—McAulay, Fields, Fisher, Goldstein & Nissen

[57] ABSTRACT

A roll packaging arrangement for applying headers or corresponding package units on paper rolls or the like of different diameter. The arrangement comprises a storage unit for the headers and an application unit including press members. Each header size has its own movable storage level, onto which headers are placed in a certain position and which are movable from a storage position to a working position for delivering headers of a desired size. There is a transmission member provided with catch means for transmitting a header from a storage level in a working position to a press member of the application unit. The location of the headers on the storage levels and the operation of placing a header onto the press member guided on the basis of the position of the header edge, so that the header, irrespective of the size of the roll to be packed, is placed in its proper place at the end face of the roll.

7 Claims, 3 Drawing Figures

ROLL PACKAGING ARRANGEMENT

Figure 1:
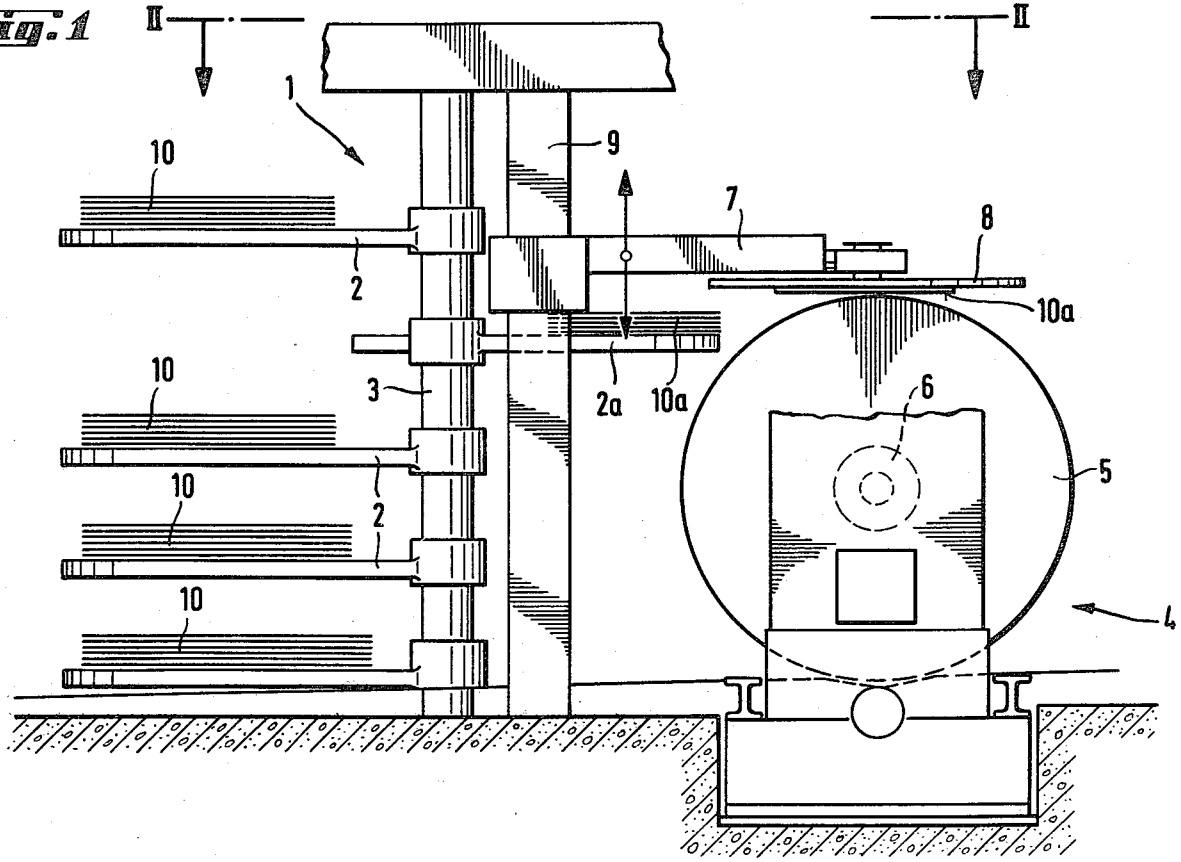

The invention relates to a roll packaging arrangement for applying headers or corresponding package units onto paper rolls or the like of different diameters, which arrangement comprises a storage unit for the headers or the like and an application unit provided with press members.

A conventional paper roll package comprises a wrapper wound round the roll and roll headers. In addition, it is possible to strengthen the edges of the roll, if so desired. Until now a considerable amount of manual work has been required when applying the headers. There are in fact some application devices for headers, but they are primarily designed for one or just a few header sizes. Nevertheless, the known devices are rather complicated and require practically continuous supervision. However, these known devices have not made it possible to handle a great number of different header sizes, which is a considerable disadvantage, because the diameter of paper rolls nowadays in use may vary from about 700 to 1800 mm, dependent on the paper grade. Thus, the application of roll headers can easily form a bottleneck in the process of roll packaging.

The object of the invention is to provide a new roll packaging arrangement for applying headers to the rolls, which arrangement is as reliable in service as possible, easily controllable and able to handle automatically a great number of different header sizes. The invention is characterized in that, in the storage unit, each header size has its own movable storage level, on which headers have been placed in a certain position and which are arranged to be moved from a storage position to a working position for delivering headers of a desired size, that the arrangement comprises a transmission member provided with catch means, that said transmission member is arranged to catch, using said catch means, a header from a storage level moved into working position and thereafter is arranged to transmit the header to a press member of the application unit, and that the location of the header on the storage level, its moving and placing onto the press member is arranged to be guided on the basis of the position of the edge of the header so that the header, irrespective of the size of the paper roll or the like to be packed, is placed in its proper place at the end face of a roll. In this way, the application of headers is made simple, and changing to another header size can easily be effected. It is possible to store in the storage unit a very great number of different header sizes, which all are equally easily at disposal. Because of the simple construction of the arrangement and the guiding on the basis of the edge of the header, the function of the arrangement is reliable and in no way depends on the header size used. In this way, the application of the header is carried out without difficulty irrespective of what diameter the rolls received from the production have, which facilitates the planning of the production and speeds up the total handling of the rolls.

For catching a header and transmitting the header to said press member, a catch plate provided with suction devices is axially turnable relative to the transmission member and can be arranged at the end of the transmission member. It is also of advantage to provide the press member with suction devices for keeping the header on said press member. In this way, the transmitting of the header is carried out safely without damaging the header.

The header application can be speeded up if the attachment unit comprises two press members which are arranged to axially transmit headers to the ends of a paper roll or the like. Thereby, the arrangement can advantageously include, for both press members, their own header storage unit and transmission member with catch means.

With regard to the construction of a paper roll or the like as well as with regard to its handling, it is of advantage to move the rolls axially on a roll packaging line, whereby the rolls preferably should be brought also to the header application unit in an axial direction. Due to this and for obtaining a proper cooperation between the storage unit and the application unit and between these units and the roll packaging line, at least one press member is provided with means, for instance, with a swingable lever support, for moving the press member away from the transport line of the rolls from its press position to a side position closer to the storage unit, where a header can be placed on the press member when the following roll to be packed is moved into said application unit. After this said means move the press member back to the transport line of the rolls to its press position for applying the header to the roll. The movements of the application unit can be guided and synchronized in accordance with the movements of the rolls.

It is of advantage to arrange the function of said application unit to be controlled, guided and synchronized in accordance with the movements of the rolls, whereby the passing time of the rolls can be minimized.

Figure 2:
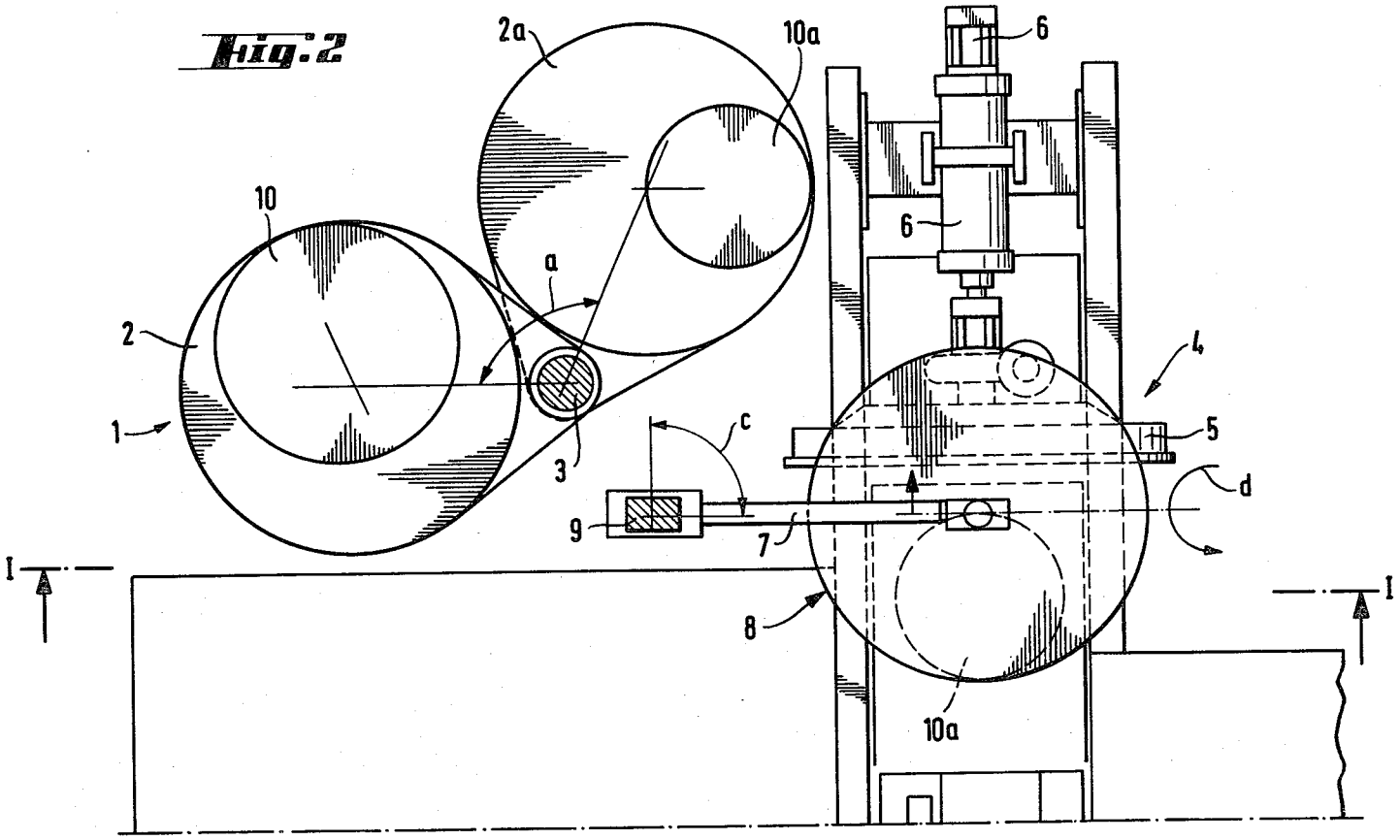
Figure 3:
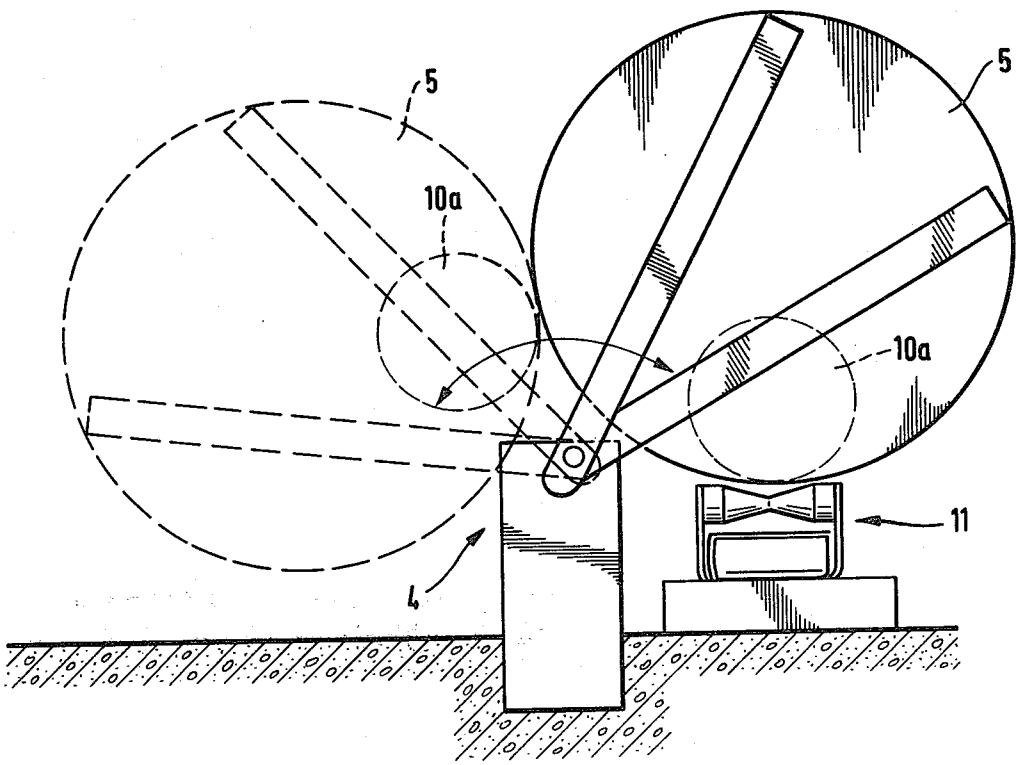

In the following, the invention will be more fully described with reference to the accompanying drawings, in which;

FIG. 1 shows schematically a side view of an embodiment of a roll packaging arrangement, FIG. 2 shows a plan view of the roll packaging arrangement of FIG. 1, and FIG. 3 shows an axial side view of another embodiment of the roll header application unit.

In the drawing, numeral 1 indicates a storage unit for roll headers, which comprises, journalled on a support 3, storage levels 2 for headers 10 of different sizes. The device also comprises a header application unit 4 provided with press members 5, a power unit 6 and a transmission member 7 with a catch plate 8 guided by a support 9.

The roll packaging arrangement shown in FIGS. 1 and 2 functions in the following way: According to the actual diameter of the roll to be packed, storage level 2*a* carrying roll headers 10*a* of a corresponding size is moved from storage unit 1 to a working position for delivering the headers (angle a in FIG. 2). Catch plate 8 of transmission member 7 catches the uppermost header of the pile with suction devices and, turning preferably about 90 degrees (angle c) takes the header to press member 5. For transmitting the header further from catch plate 8 to press member 5, catch plate 8 is turned axially relative to transmission member 7, suitably about 90 degrees (angle d), and transmission member 7 is lowered so that it comes to the right position relative to press member 5 and the roll to be packed, after which suction devices in press member 5 (not shown in the Figures) catch the header. When transmission member 7 has been moved to fetch a new header, press member 5 transmits the header to the roll. It is of advantage to use in the arrangement two press members 5 of corresponding configuration having each a storage unit 1 and a transmission member 7, which press members are functionally synchronized with the transport line of the roll, whereby press members 5 simultaneously press headers to both ends of the roll.

The movements indicating transport of the headers are shown in the Figures with arrows and with moving or turning angles a, c and d, the values of which advantageously should be so chosen, that putting the headers on the storage plates and their transport movements will be as easy as possible to carry out, in particular with regard to making the function of the whole arrangement automatic. The solution chosen is based on controlling the transport system going out from the edge of the header so that the lower edge of a header takes a position level with the roll transport line and with the lower edge of the roll to be packed when the header is on a press member ready to be pressed to the roll. By choosing suitable values for said angles, it is then possible to calculate a predetermined position for the headers on the storage levels so that the transport system of the headers functions perfectly. The transport movements can be made accurate, for instance, by using mechanical stops or the like. When all of the storage levels are vertically aligned and the edges of the headers that are to be located at the bottom of the rolls are placed in a certain position on the various storage levels, the angular movement of the different storage levels and of the transmission member can be constant regardless of the size of the header being applied. In order that catch plate 8 would transmit only one header at a time, it is possible to guide catch plate 8 so that it is somewhat inclined relative to the horizontal plane before lifting and transmitting a header from storage level 2. Naturally, storage unit 1 itself and the moving of storage levels 2 to working position can be designed in many different ways.

FIG. 3 shows an application unit 4, having press members 5 which can be moved away from their press position to a so called side position (shown with broken lines), where the header to be attached is transmitted to the press member. Thereby, the angles mentioned above and the transmission movements of the headers are to be chosen and calculated on the basis of the right position of the header when the press member is in its press position. Moreover, it is possible to use with this application unit both the storage unit and the transmission member construction described above. The embodiment of FIG. 3 is particularly advantageous because the rolls can be brought to application unit 4 in their axial direction along transport line 11 and can, if desired, also be transported in the same position away from application unit 4. To minimize the handling time of a roll, one of the press elements of application unit 4 can be arranged to move axially following the roll immediately when the roll has passed the press member in question. Thus, the waiting time before the headers are attached to the roll, when the roll meets the other press member of the attachment unit, will be as short as possible. FIG. 3 does not show in detail the turning- and moving devices of the press member, because they can be designed in any conventional way.

The invention is not limited to the embodiments shown, but several variations thereof are feasible within the scope of the attached claims.

We claim:

1. A packaging arrangement for selecting and applyIng roll headers or corresponding package units onto basically horizontally oriented rolls of different diameter, which arrangement comprises:

a storage unit for said headers or the like, an application unit including a press member with a basically vertical press surface, and a transmission member provided with catch means for transmitting a header to said press member, said storage unit comprising a pivotable storage level for each header size, on which said headers are placed in an exactly defined position, said storage levels being basically vertically aligned in a storage position, means for angularly moving said storage levels from said storage position to a working position for delivering headers of a desired size, means for angularly moving said transmission member between said working position and a basically vertical delivery position adjacent said press member to thereby catch, by means of said catch means, a selected header transmitted by a storage level to said working position and to transmit said selected header to said press member, and each of said headers having an edge to be placed at the bottom of said roll, whereby the exact location of the header on each storage level is determined on the basis of the location of said edge of said headers with respect to a basically constant movement pattern of said storage levels as well as of said transmission member, and, in particular, with respect to the lower edge of said transmission member when being in said vertical header delivery position so that said edges of the different size headers are always in the same position on said storage level and said transmission member thereby ensuring proper positioning of any selected header at the end face of said rolls, said angular movements of said storage levels being the same fixed amount for each different size header applied operation as well as angular movement of said transmission member being the same fixed amount in each of said operations irrespective of the size of the roll to be headed and the size of the selected header.

2. A packaging arrangement for selecting and applying roll headers or corresponding package units onto horizontally oriented rolls of different diameter, which arrangement comprises;

a storage unit for said headers or the like;

an application unit including a horizontally movable and vertically oriented press member;

a transmission member provided with catch means for transmitting a selected header from said storage unit to said press member;

said storage unit comprising a plurality of basically horizontally oriented movable storage levels, one for each header size, carrying headers in an exactly defined position;

means for moving said storage levels from a storage position to a working position for delivering headers of a desired size;

means for moving said transmission member to a position corresponding to the working position of a selected storage level to catch a selected header, by means of said catch means, from said selected storage level brought to said working position, as well as for moving said transmission member to a basically vertical header delivery position adjacent said press member for transmitting thereby said selected header from said selected storage level to said press member; and each of said headers having an edge portion to be placed at the bottom of said roll, whereby the exact location of the header on each storage level is determined on the basis of the location of said edge portion of said headers with respect to a movement pattern of said storage levels as well as of said transmission members, and, in particular, with respect to a lower edge of said transmission member when being in said vertical header delivery position, said edge portion of the different size headers being always in the same position on each of said storage levels and on said transmission member, thereby ensuring proper positioning of any selected header at the end face of said roll, irrespective of the size of the roll to be headed and the corresponding size of the selected header.

3. A roll packaging arrangement according to claim 2, in which, at the end of said transmission member, there is a catch plate provided with suction means, said catch plate being turnable on the transmission member and movable for catching a header and moving it to one of said press members.

4. A roll packaging arrangement according to claim 2 or 3, in which said press members have suction means for keeping a header on the press member.

5. A roll packaging arrangement according to claim 2, in which, in said application unit, there are two press members which are axially movable relative to a roll to be packed, and that the arrangement comprises, for both press members, their own header storage unit and their own transmission member with catch means.

6. A roll packaging arrangement according to claim 5, in which at least one of said press members is provided with means, for moving the press member between its press position and a side position closer to said storage unit, in which latter position said press member is arranged to receive a header when a roll to be packed is moved into said application unit.

7. A roll packaging arrangement according to claim 5, in which the movements of said application unit are guided and synchronized in accordance with the movements of said rolls.

* * * * *